US008520890B2

(12) United States Patent
Gobbels

(10) Patent No.: US 8,520,890 B2
(45) Date of Patent: Aug. 27, 2013

(54) METHOD AND DEVICE FOR DETERMINING THE ORIENTATION OF A CROSS-WOUND BOBBIN TUBE

(75) Inventor: Heinz-Dieter Gobbels, Monchengladbach (DE)

(73) Assignee: Oerlikon Textile GmbH & Co. KG, Remscheid (DE)

( * ) Notice: Subject to any disclaimer, the term of this patent is extended or adjusted under 35 U.S.C. 154(b) by 409 days.

(21) Appl. No.: 12/966,527

(22) Filed: Dec. 13, 2010

(65) Prior Publication Data

US 2011/0150281 A1 Jun. 23, 2011

(30) Foreign Application Priority Data

Dec. 17, 2009 (DE) ..... 10 2009 058 720

(51) Int. Cl.
*G06K 9/00* (2006.01)

(52) U.S. Cl.
USPC ..... 382/100; 382/103

(58) Field of Classification Search
None
See application file for complete search history.

(56) References Cited

U.S. PATENT DOCUMENTS 5,020,110 A * 5/1991 Chominski ..... 382/137
5,426,307 A 6/1995 Masai et al.
6,216,432 B1 4/2001 Sanfeliu Cortes et al.
6,580,813 B1 6/2003 Hermanns et al.
2008/0260256 A1* 10/2008 Zeng et al. ..... 382/195

FOREIGN PATENT DOCUMENTS

| | | | |
|---|---|---|---|
| DE | 2412821 | A1 | 9/1975 |
| DE | 3912602 | A1 | 10/1990 |
| DE | 4323547 | A1 | 1/1994 |
| DE | 4341946 | A1 | 6/1995 |
| DE | 4421778 | C2 | 1/1996 |
| DE | 19836071 | A1 | 2/2000 |
| DE | 19840299 | A1 | 3/2000 |
| DE | 69705532 | T2 | 5/2002 |
| JP | 2000086091 | A * | 3/2000 |

* cited by examiner

*Primary Examiner* — Stephen R Koziol
*Assistant Examiner* — Raphael Schwartz
(74) *Attorney, Agent, or Firm* — K&L Gates LLP

(57) ABSTRACT

A method and device for determining the orientation of a cross-wound bobbin tube (1) having a yarn draw-off end face (27) configured as a tube tip (2) with a beaded edge (4) and an opposite end face (27) configured as a tube foot (3) without a beaded edge (4). A digital image of an end face (27) of the bobbin tube (1) is detected, the digital image is subjected to an edge detection to determine the object edges (6, 7, 8, 9) of the tube (1), a recognition parameter dependent on the width ($b_1$, $b_2$) of the circular ring (10, 11) formed by the object edges (6, 7, 8, 9) is determined, this recognition parameter is compared with a reference value and a conclusion is drawn about the orientation of the bobbin tube (1) depending on the result of the comparison.

14 Claims, 5 Drawing Sheets

METHOD AND DEVICE FOR DETERMINING THE ORIENTATION OF A CROSS-WOUND BOBBIN TUBE

CROSS-REFERENCES TO RELATED APPLICATIONS

This application claims the benefit of German patent application DE 10 2009 058 720.9, filed Dec. 17, 2009, herein fully incorporated by reference.

FIELD OF THE INVENTION

The present invention relates to a method for determining the orientation of a bobbin tube for cross-winding of a textile yarn thereon, wherein the bobbin tube is of the type having one end face at a yarn withdrawal end of the tube configured as a tube tip with a beaded edge and the other end face at the opposite end of the tube configured as a tube foot without a beaded edge. The invention also relates to a device for carrying out the orientation-determining method.

BACKGROUND OF THE INVENTION

In textile machines producing cross-wound bobbins, for example open-end spinning machines or winding machines, yarns are wound onto empty bobbin tubes to form cross-wound bobbins. In the development of cross-wound bobbins, the yarns are generally drawn off overhead. In order to prevent the yarn becoming caught or rubbing on the edge of the tube while being drawn off, the tube is beaded on the tube tip toward the withdrawal end of the tube. Furthermore, a peripheral groove for depositing a foot reserve may be provided on the tube foot at the opposite end of the tube. A groove of this type is also called a yarn reserve channel. It emerges from the aforementioned configuration of the bobbin tube that correct orientation of the bobbin tube is necessary in the production of the cross-wound bobbin.

It is known that textile machines producing cross-wound bobbins are equipped with tube magazines, from which the tubes can be transported in an automated manner to the workstations of the textile machine. These tube magazines are loaded manually by an operator. The operator has to place the bobbin tubes with correct orientation on mandrels of the tube magazine.

The constant aim is to automate work sequences on textile machines producing cross-wound bobbins. Bobbin tubes may, for example, be automatically conveyed from a bulk goods container. In this case, the bobbin tubes are transported from the container with a random orientation. To further process the bobbin tubes, it is absolutely necessary to determine the orientation of each bobbin tube followed by a corresponding alignment of the tube.

German Patent Document DE 43 41 946 A1, discloses a mechanism for transporting the bobbin tubes within a textile machine producing cross-wound bobbins, including a mechanical sensor mechanism for determining the orientation of a bobbin tube, which is configured as described above. This sensor mechanism is configured as a tube sensing device which scans the tube ends and responds to the beading of a tube. Mechanical mechanisms of this type are expensive, susceptible to faults and require maintenance.

German Patent Document DE-OS 24 12 821 discloses a device for automatically supplying and properly aligning bobbin tubes. In order to be able to determine the orientation of the bobbin tubes, the bobbin tubes are marked on the end faces by labelling, printing, dyeing or the like. A photoelectric reflex light barrier is directed at the end face of a bobbin tube passing by. The reflex light barrier responds to the markings, in this case. It irradiates the end face with light and measures the reflected light quantity. The light quantity is changed by the marking. The production of the markings means a considerable outlay of expense. This method has therefore not proven successful.

German Patent Document DE 198 40 299 A1 discloses a device for recognizing the orientation of cops. An optical scanning device is also described here. The fact that the foot of the spinning cops has a larger diameter than the tip of the spinning cop is utilized in that the shading perpendicular to the spinning cop axis is measured at the spinning cop ends. A measuring arrangement of this type is inapplicable for cylindrical bobbin tubes.

SUMMARY OF THE INVENTION

It is therefore an object of the present invention to provide a simple and reliable possibility for determining the orientation of a bobbin tube.

The object is addressed according to the present invention by a method and a device for determining the orientation of a bobbin tube of the type for cross-winding of a textile yarn thereon, wherein the bobbin tube has one end face at a yarn withdrawal end of the tube configured as a tube tip with a beaded edge and has another end face at the opposite end of the tube configured as a tube foot without a beaded edge.

To achieve the object, the cross-wound bobbin tube is firstly arranged opposite an image processing mechanism and a digital image of an end face is then detected. The digital image is subjected to an edge detection in order to determine the object edges of the cross-wound bobbin tube, a recognition parameter which is dependent on the width of the circular ring formed by the object edges is determined, the recognition parameter thus determined is compared with a reference value which depends on the tube parameters and a conclusion is drawn about the orientation of the cross-wound bobbin tube depending on the result of the comparison.

The solution according to the invention inevitably uses differences present on a tube tip between the tube tip and the tube foot. The circular ring detected on the digital image is wider on the tube tip than on the tube foot owing to the beaded edge. The absolute width of the circular ring does not, however, need to be determined. It is absolutely sufficient to determine a recognition parameter that depends on the width. Methods for edge detection are known per se in the area of digital image processing and can easily be implemented. The outlay for computing for the method according to the invention is comparatively low. The method can be used in the same way for cylindrical and for conical bobbin tubes.

There are a large number of possibilities for calculating a recognition parameter. The width of the circular ring itself or the internal diameter of the cross-wound bobbin can be determined. However, it is particularly advantageous to use relative variables as the recognition parameter. The evaluation is insensitive to displacements of the bobbin tube owing to a relative measurement. This type of evaluation also takes into account the fact that absolute measurements cannot be directly taken from a digital image. It is possible, for example, to use the ratio of the internal and external diameter. However, it has proven to be advantageous to use the quotient of the external diameter of the bobbin tube and the width of the circular ring as the recognition parameter. This is a simple and reliable relative measurement. This quotient clearly differs between the tube tip and the tube foot.

To carry out the edge detection, the digital image may be represented by a grey scale value matrix, each element of the grey scale value matrix allocating a grey scale value to a pixel. However, a coloured image with the colour matrices belonging thereto is also not necessary in principle to recognize the circular ring at the end face of the bobbin tube.

According to a further development of the invention, an edge matrix is determined from the grey scale value matrix for edge detection, each element of the edge matrix allocating a value to a pixel and it being recognisable with the aid of the values which pixel belongs to an object edge.

The object edge is located at the point at which the change in brightness is greatest. An edge image can be produced in that, for each point of the grey scale value matrix, the absolute value of the gradient, in other words the change in the brightness, is calculated. The calculated absolute values produce a gradient matrix, and each element of the gradient matrix allocates a gradient absolute value to a pixel. This gradient matrix is already an edge matrix.

According to a development of the invention, the gradient absolute values from the gradient matrix are compared with a threshold value and an object edge is recognized when the absolute value of the gradient exceeds the threshold value. This threshold value switch means that areas of the image, in which no adequately large change in the brightness occurs, are not recognized as the object edge.

Advantageously, the value 1 is allocated to an element of a threshold value matrix when the associated pixel is recognized as the object edge and the value 0 is allocated to an element of the threshold value matrix when the associated pixel is not recognized as the object edge. The maximum difference between the object edge and the surrounding pixels is thus achieved with a minimum storage outlay for the threshold value matrix. The threshold value matrix is an improved edge matrix. The associated image has a stronger contrast than the edge image from the gradient matrix. The danger of faulty interpretations is significantly lower.

According to a development of the method according to the invention the center point of the circles formed by the object edges is determined by means of the edge matrix. For this purpose, the pixels can be interpreted as mass points and the focal point of the mass points can be determined, which coincides with the center point, as the pixels on the circles are point-symmetrical to the center point.

Line profiles can be detected, the line profiles providing the elements of the edge matrix, the pixels of which are located on a straight line. One of the straight lines belonging to the line profiles runs through the center point of the circles formed by the object edges and the straight lines of the other line profiles run parallel with the straight line through the center point and through pixels adjacent to the center point. Furthermore, the sum of the line profiles is formed.

A respective value proportional to the width of the circular ring and the external diameter of the bobbin tube can be determined from the position of the maxima of the course of the sum of the line profiles. The quotient of these values then corresponds to the quotient of the width and external diameter.

It is possible in principle to detect a digital image of the two end faces of each bobbin tube and use the recognition parameter of the respective other end face as the reference value. However, it is easier to carry out this detection only once for a type of tube or to calculate the recognition values from the known geometric dimensions. The comparative value for a type of tube can then be determined from the mean value of the recognition parameter of the tube tip and the tube foot.

To achieve the object, a device for determining the orientation of a bobbin tube for a cross-wound bobbin and for carrying out the method according to the invention is also proposed. According to the invention, the device has an image processing mechanism in the from of a digital camera and means are present to arrange the digital camera and the bobbin tube with respect to one another in such a way that a digital image of an end face of the cross-wound bobbin tube can be detected. Furthermore, the device has an evaluation mechanism, which is configured to subject the digital image to an edge detection to determine the object edges of the cross-wound bobbin tube, to determine a recognition parameter which depends on the width of the circular ring formed by the object edges, to compare this recognition parameter with a reference value which depends on the tube parameters and to come to a conclusion about the orientation of the cross-wound bobbin tube depending on the result of the comparison.

A simple black and white camera can be used as the digital camera and these work reliably nowadays and are economically available. Known processor units can easily be formed by software supplementation in order to carry out the evaluation according to the invention.

The device is substantially independent of light influences owing to its own lighting.

BRIEF DESCRIPTION OF THE DRAWINGS

The invention will be described in more detail below with the aid of an embodiment shown in the drawings, in which.

DETAILED DESCRIPTION OF THE PREFERRED EMBODIMENTS

Figure 1:
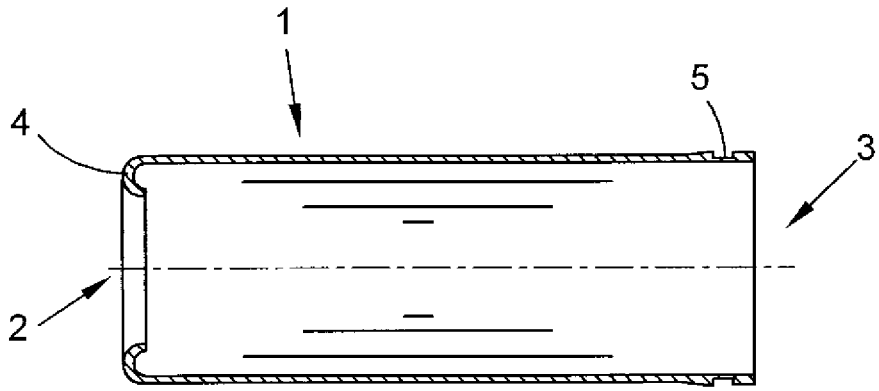
FIG. 1 shows a bobbin tube with a beaded edge.

FIG. 1 shows a known embodiment of a cylindrical bobbin tube 1. It is cut along its longitudinal axis. On its draw-off side 2 of the yarn, it has an inwardly directed beading 4 of the wall. The beaded edge prevents the yarn, which is running off, being caught on the end face of the tube on a damaged edge of the wall. A groove 5 is incorporated on the periphery of the bobbin tube 1 at the opposing end of the bobbin tube 1, the tube foot 3, at a spacing from the edge. It is used to fix a starting reserve.

Figure 2:
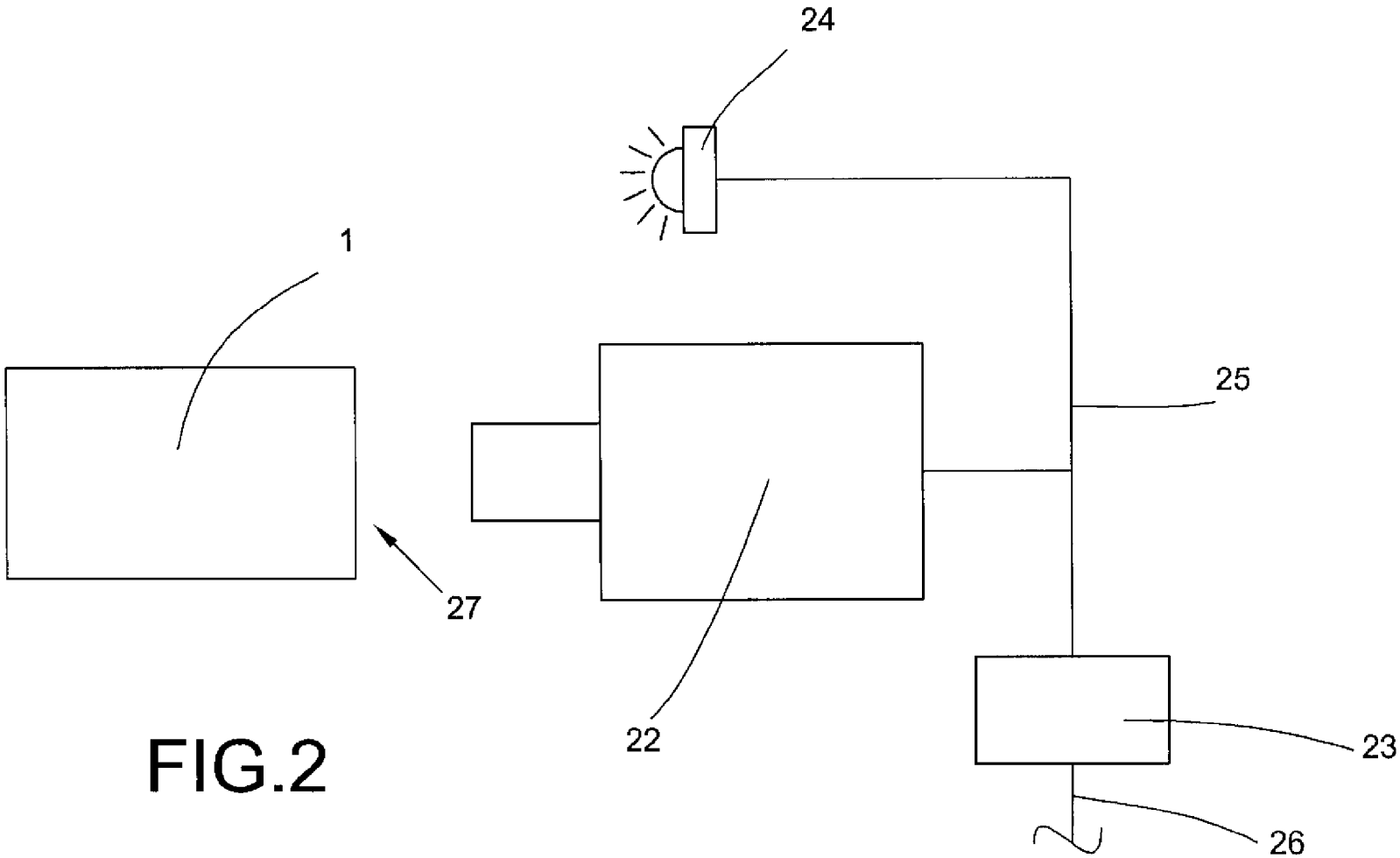
FIG. 2 shows a schematic view of a device according to the invention to determine the orientation of the bobbin tube.

FIG. 2 schematically shows a view of a device for determining the orientation of the bobbin tube 1. A digital camera 22 is arranged in such a way that it can detect an end face 27 of the bobbin tube 1. In the present embodiment, this is a black and white camera. The digital camera 22 is connected by a control line 25 to a control and evaluation unit 23. This initiates the image detection and carries out the edge detection and the determination of a recognition parameter. The control and evaluation unit 23 also controls a lighting mechanism 24. The end face 27 is illuminated thereby and the detection of the image becomes independent of external light influences. The device is arranged here in such a way that the bobbin tubes are checked for their orientation before they are supplied to the workstations of a textile machine producing cross-wound bobbins. The control and evaluation unit 23 is connected to the remaining control units of the textile machine producing cross-wound bobbins by means of the control line 26 so the bobbin tube can be correspondingly aligned on the basis of the determined orientation.

Figure 4:
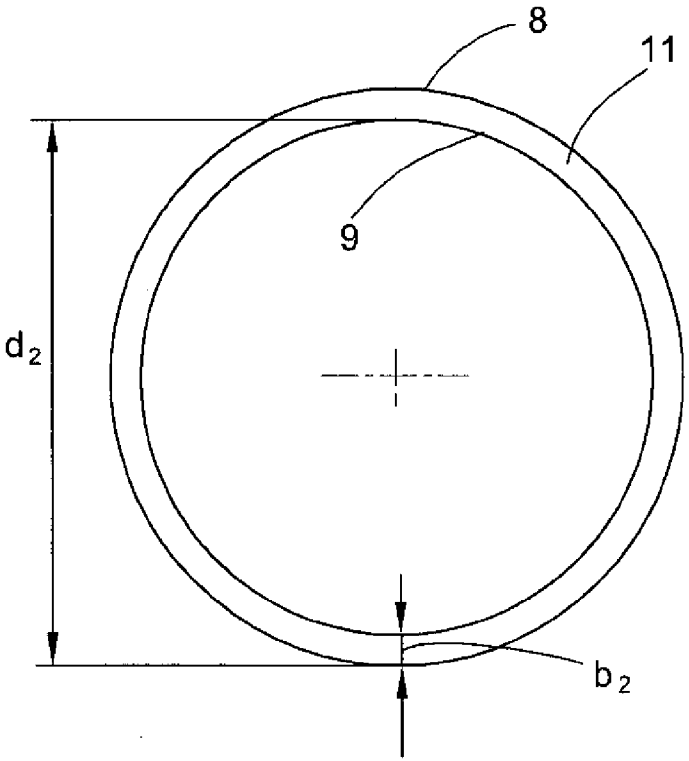
FIG. 4 shows a view of the end face of the bobbin tube configured as a tube foot.
Figure 3:
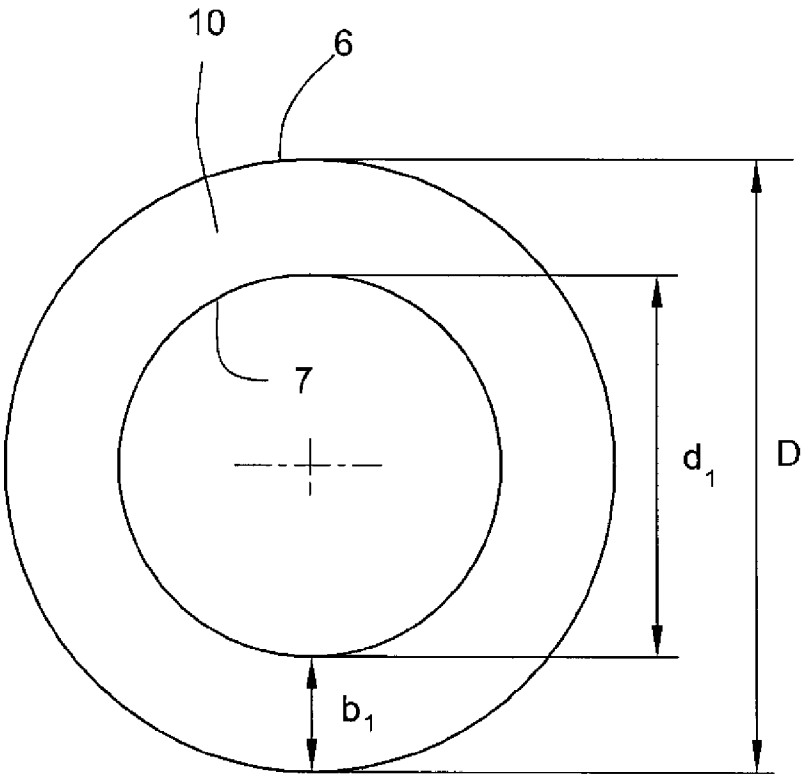
FIG. 3 shows a view of the end face of the bobbin tube configured as a tube tip.

FIGS. 3 and 4 in each case show an end face 27 of the bobbin tube 1. FIG. 3 in this case shows the object edges of the tube tip 2. There are two circular lines 6 and 7, which form a circular ring 10. The circular ring 10 has the external diameter D, the internal diameter $d_1$ and the width $b_1$. FIG. 4 shows the object edges of the tube foot 3. The circular lines 8 and 9 form the circular ring 11. The external diameter D is identical to that of FIG. 3. The internal diameter $d_2$ is larger than the internal diameter $d_1$ at the tube tip 2. Accordingly, the width $b_2$ of the circular ring 11 at the tube foot 3 is smaller than the width $b_1$ of the circular ring 10 at the tube tip 2. The difference is based on the beaded edge 4 at the tube tip 2. The present invention utilizes this difference. A recognition parameter K is calculated from the geometric dimensions.

In the present embodiment, this is the quotient of the external diameter D and the width b of the circular ring. Equation (i) shows the calculation.

$$K = \frac{D}{b} \tag{i}$$

No absolute geometric dimensions have to be calculated in this recognition parameter. Relative measurements are sufficient.

In order to determine the recognition parameter, a digital image is produced. This image is represented by a grey scale value matrix G with I lines and J columns, as given in equation (ii). Each element $g_{1,j}$ of the matrix represents a pixel.

$$G = \begin{pmatrix} g_{0,0} & g_{0,1} & g_{0,2} & g_{0,3} & \cdots & g_{0,J-1} \\ g_{0,0} & g_{0,0} & g_{0,0} & g_{0,0} & \cdots & g_{1,J-1} \\ g_{0,0} & g_{0,0} & g_{0,0} & g_{0,0} & \cdots & g_{2,J-1} \\ g_{0,0} & g_{0,0} & g_{0,0} & g_{0,0} & \cdots & g_{3,J-1} \\ \vdots & \vdots & \vdots & \vdots & \ddots & \vdots \\ g_{I-1,0} & g_{I-1,1} & g_{I-1,2} & g_{I-1,3} & \cdots & g_{I,J-1} \end{pmatrix} \tag{ii}$$

The circular lines firstly have to be recognized. For this purpose, the image is subjected to an edge detection. The object edge is at the point, at which the change in brightness is greatest. The change leads to the concept of the derivation or, for the two-dimensional image, to the concept of the gradient. In other words, for each point of the image, or express differently, for each point (i, j) of the grey scale value matrix G, as shown in equation (iii), the gradient ∇g(i, j) is firstly calculated.

$$\nabla(i, j) = \begin{pmatrix} g(i, j+1) - g(i, j-1) \\ g(i+1, j) - g(i-1, j) \end{pmatrix} \tag{iii}$$

The gradient at the point (i, j) is a vector. The first component of the vector provides the change in the line direction and the second component provides the change in the column direction. In order to obtain this information about the change in the brightness in a pixel, or at the point (i, j) of the grey scale matrix, the absolute value of the gradient is used, which is calculated according to (iv).

$$|\nabla g(i, j)| = \sqrt{(g(i,j+1) - g(i,j-1))^2 + (g(i+1,j) - g(i-1,j))^2} \tag{iv}$$

The absolute value of the gradient at the point (i, j) defines a new matrix, the gradient matrix. The gradient matrix consists, in accordance with the grey scale matrix, of I lines and J columns. In the graphic view, an edge image, which ideally corresponds to the view of FIGS. 3 and 4 is produced. However, in practice, small changes in the brightness are also shown in an edge image of this type as the object edge. For this reason, the elements of the gradient matrix are compared with a threshold value T. This means that areas of the image, in which no adequately large change in the brightness takes place, are not recognized as the object edge. The comparison leads to a new matrix of the threshold value matrix with the elements $g_{sw}(i, j)$. The calculation thereof is shown in equation (v).

$$g_{SW}(i, j) = \begin{cases} 1 & \text{if } g_{edge\ image}(i, j) \geq T \\ 0 & \text{if } g_{edge\ image}(i, j) < T \end{cases} \tag{v}$$

The threshold value T, in accordance with equation (vi), can be calculated depending on the maximum brightness value of the edge image. $c_T$ is a proportionality factor.

$$T = c_T \max(g_{edge\ image}(i, j)) \tag{vi}$$

In the graphic view, a threshold value image which has a stronger contrast compared to the edge image, is produced from the threshold value matrix.

In order to determine the geometric dimensions of the circular ring, the center point of the circles forming the circular ring can firstly be determined. For this purpose, the pixels can be considered to be the mass points in one plane. As the points on the circles are point-symmetrical with respect to the center point, the center point and focal point coincide. The focal point $\vec{r}_{sp}$ of an N-part system is calculated according to equation (vii), wherein $m_i$ is the mass of the ist parts and $\vec{r}_i$ is the associated position vector.

$$\vec{r}_{sp} = \frac{1}{M} \sum_{i=1}^{N} m_i \cdot \vec{r}_i \tag{vii}$$

The total mass M is produced from equation (viii).

$$M = \sum_{i=1}^{N} m_i \tag{viii}$$

If the calculation is transferred to the image processing, the masses $m_i$ correspond to the elements $g_{sw}(i, j)$ of the threshold value matrix. The coordinates $(i_{sp}, j_{sp})$ of the focal point or of the center point therefore emerge from equation (ix) to (xi)

$$j_{sp} = \frac{1}{M} \sum_{j=0}^{J-1} \sum_{i=0}^{I-1} g_{SW}(i, j) \cdot j \tag{ix}$$

$$i_{sp} = \frac{1}{M} \sum_{j=0}^{J-1} \sum_{i=0}^{I-1} g_{SW}(i, j) \cdot i \tag{x}$$

-continued $$M = \sum_{j=0}^{J-1} \sum_{i=0}^{I-1} g_{SW}(i, j) \quad \text{(xi)}$$

Figure 5:
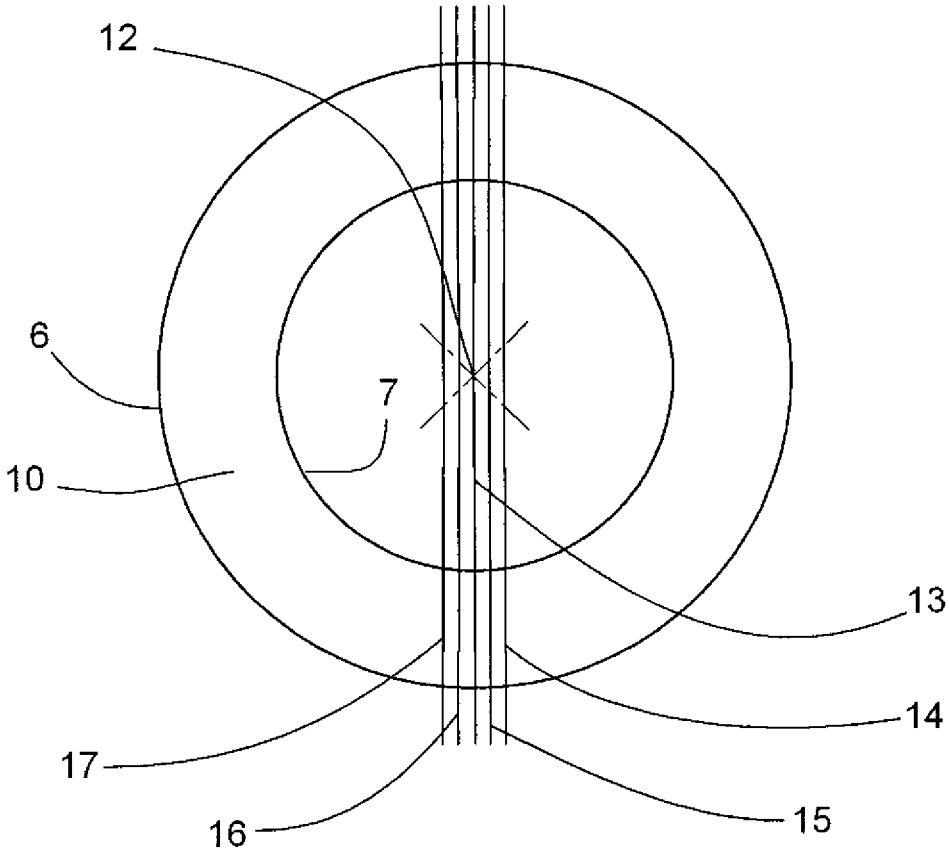
FIG. 5 shows a view like FIG. 3 with straight lines belonging to line profiles.
Figure 6:
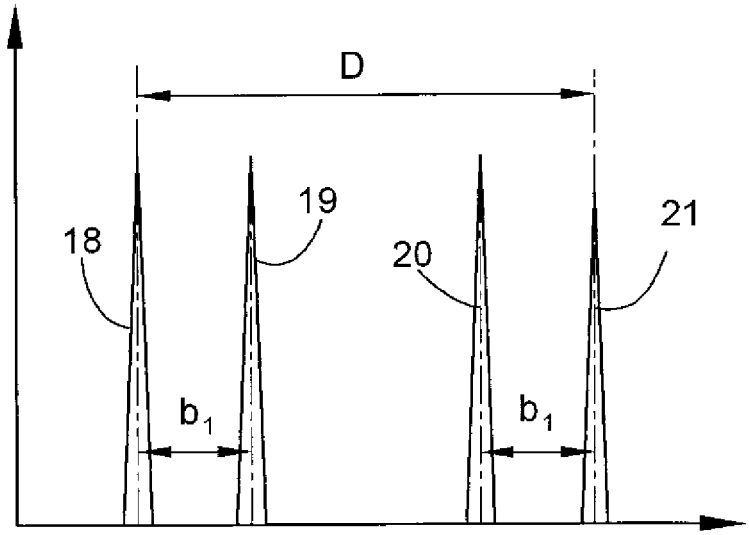
FIG. 6 shows a course of the sum of the line profiles from FIG. 5.

Therefore, the center point of the circles is known and has the reference numeral 12 in FIG. 5. The straight line 13 runs through the center point 12. The elements of the threshold value matrix, the pixels of which lie on this straight line, define a line profile. In order to compensate any inaccuracies in the edge detection, further line profiles are determined. These are represented by the straight lines 14, 15, 16 and 17, which run parallel with the straight line 13 and through adjacent pixels. The sum of the line profiles is formed for further evaluation. The course of this sum is shown in FIG. 6. The maxima 18, 19, 20 and 21 represent the points of intersection of the straight lines 13, 14, 15, 16 and 17 with the circular lines 6 and 7. All of the geometric dimensions of the threshold value image can be determined from this line profile course, in particular the external diameter D and the width $b_1$ of the circular ring. The external diameter D is produced from the spacing of the maxima 18 and 21. The width $b_1$ of the circular ring is represented by the spacing of the maxima 18 and 19 and the spacing of the maxima 20 and 21. The recognition parameter K can now be determined with this information. The latter can be compared with a reference value in order to decide which end face 27 of the bobbin tube 1 has been detected by the camera 22.

The reference value for the respectively used tube type is determined in advance in the present embodiment, in that the mean value of the recognition parameter of the tube tip and of the tube foot is calculated. Each newly detected recognition parameter is compared with the reference value. If the recognition parameter is smaller than the reference value, this is the tube tip. If the recognition parameter is greater than the reference value, this is the tube foot.

Those persons skilled in the art will thus recognize and understand that the invention is susceptible of broader utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, it is to be understood that the foregoing disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A method for determining the orientation of a bobbin tube (1) of the type for cross-winding of a textile yarn thereon, wherein the bobbin tube has one end face (27) at a yarn withdrawal end of the tube configured as a tube tip (2) with a beaded edge (4) and has another end face (27) at the opposite end of the tube configured as a tube foot (3) without a beaded edge (4), the method characterized by the steps of arranging the cross-wound bobbin tube (1) opposite an image detection mechanism, detecting a digital image of one end face (27) of the cross-wound bobbin tube (1), subjecting the digital image to an edge detection in order to determine object edges (6, 7, 8, 9) of the cross-wound bobbin tube (1), determining a recognition parameter which is dependent on a width ($b_1$, $b_2$) of a circular ring (10, 11) formed by the object edges (6, 7, 8, 9), comparing the recognition parameter thusly determined with a reference value which is dependent on the tube parameters, and drawing a conclusion about the orientation of the cross-wound bobbin tube (1) depending on the result of the comparison.

2. A method for determining the orientation of a bobbin tube (1) of the type for cross-winding of a textile yarn thereon, wherein the bobbin tube has one end face (27) at a yarn withdrawal end of the tube configured as a tube tip (2) with a beaded edge (4) and has another end face (27) at the opposite end of the tube configured as a tube foot (3) without a beaded edge (4), the method characterized by the steps of arranging the cross-wound bobbin tube (1) opposite an image detection mechanism, detecting a digital image of one end face (27) of the cross-wound bobbin tube (1), subjecting the digital image to an edge detection in order to determine object edges (6, 7, 8, 9) of the cross-wound bobbin tube (1), determining a recognition parameter which is dependent on a width ($b_1$,1$_2$) of a circular ring (10, 11) formed by the object edges (6, 7, 8, 9), wherein the recognition parameter is selected as the quotient of an external diameter (D) of the bobbin tube (1) and the width ($b_1$, $b_2$) of the circular ring (10, 11), comparing the recognition parameter thusly determined with a reference value which is dependent on the tube parameters, and drawing a conclusion about the orientation of the cross-wound bobbin tube (1) depending on the result of the comparison.

3. The method according to claim 1, characterized further by representing the digital image by a grey scale value matrix, wherein each element of the grey scale value matrix allocates a grey scale value to a pixel.

4. The method according to claim 3, characterized further by determining an edge matrix from the grey scale value matrix for edge detection, each element of the edge matrix allocating a value to a pixel for associating respective pixels to respective object edges.

5. The method according to claim 4, characterized further by calculating the absolute value of the gradient for each point of the grey scale value matrix, the calculated absolute values producing a gradient matrix and each element of the gradient matrix allocating a gradient absolute value to a pixel.

6. The method according to claim 5, characterized further by comparing the gradient absolute values from the gradient matrix with a threshold value and recognizing an object edge (6, 7, 8, 9) when the absolute value of the gradient exceeds the threshold value.

7. The method according to claim 6, characterized further by allocating a numeral 1 value to an element of a threshold value matrix when the associated pixel is recognized as the object edge (6, 7, 8, 9), and allocating a zero value to an element of a threshold value matrix when the associated pixel is not recognized as the object edge (6, 7, 8, 9).

8. The method according to claim 4, characterized further by determining the center point (12) of circles formed by the object edges (6, 7, 8, 9) by means of the edge matrix.

9. A method for determining the orientation of a bobbin tube (1) of the type for cross-winding of a textile yarn thereon, wherein the bobbin tube has one end face (27) at a yarn withdrawal end of the tube configured as a tube tip (2) with a beaded edge (4) and has another end face (27) at the opposite end of the tube configured as a tube foot (3) without a beaded edge (4), the method characterized by the steps of arranging the cross-wound bobbin tube (1) opposite an image detection mechanism, detecting a digital image of one end face (27) of the cross-wound bobbin tube (1), subjecting the digital image to an edge detection in order to determine object edges (6, 7, 8, 9) of the cross-wound bobbin tube (1), determining a recognition parameter which is dependent on a width ($b_1$, $b_2$) of a circular ring (10, 11) formed by the object edges (6, 7, 8, 9), comparing the recognition parameter thusly determined with a reference value which is dependent on the tube parameters, and drawing a conclusion about the orientation of the cross-wound bobbin tube (1) depending on the result of the comparison, and characterized further by representing the digital image by a grey scale value matrix, wherein each element of the grey scale value matrix allocates a grey scale value to a pixel, determining an edge matrix from the grey scale value matrix for edge detection, each element of the edge matrix allocating a value to a pixel for associating respective pixels to respective object edges, determining the center point (12) of circles formed by the object edges (6, 7, 8, 9) by means of the edge matrix, and detecting line profiles which provide elements of the edge matrix, the pixels of which lie on a straight line (13, 14, 15, 16, 17), wherein one of the straight lines (13) belonging to the line profiles runs through the center point (12) of the circles formed by the object edges (6, 7, 8, 9), the straight lines (14, 15, 16, 17) of the other line profiles run parallel with the straight line (13) through the center point (12) and through pixels adjacent to the center point (12) and the sum of the line profiles is formed.

10. The method according to claim 9, characterized further by determining a value proportional to the width ($b_1$, $b_2$) of the circular ring (10, 11) and the external diameter (D) of the bobbin tube (1) from the position of the maxima (18, 19, 20, 21) of the course of the sum of the line profiles.

11. The method according to claim 1, characterized further by determining the reference value for a tube type from a mean value of the recognition parameter of the tube tip (2) and the tube foot (3).

12. A device for determining the orientation of a bobbin tube (1) of the type for cross-winding of a textile yarn thereon, wherein the bobbin tube has one end face (27) at a yarn withdrawal end of the tube configured as a tube tip (2) with a beaded edge (4) and has another end face (27) at the opposite end of the tube configured as a tube foot (3) without a beaded edge (4), characterized in that the device comprises an image processing mechanism in the form of a digital camera (22), means for orienting the digital camera (22) and the bobbin tube (1) relative to one another such that a digital image of an end face (27) of the cross-wound bobbin tube (1) can be detected, and an evaluation mechanism (23) configured to subject the digital image to an edge detection in order to determine object edges (6, 7, 8, 9) of the cross-wound bobbin tube (1), to determine a recognition parameter which is dependent on a width ($b_1$, $b_2$) of a circular ring (10, 11) formed by the object edges, to compare the recognition parameter with a reference value which is dependent on the tube parameters and to draw to a conclusion about the orientation of the bobbin tube (1) depending on the result of the comparison.

13. A method for determining the orientation of a bobbin tube (1) of the type for cross-winding of a textile yarn thereon, wherein the bobbin tube has one end face (27) at a yarn withdrawal end of the tube configured as a tube tip (2) with a beaded edge (4) and has another end face (27) at the opposite end of the tube configured as a tube foot (3) without a beaded edge (4), the method characterized by the steps of arranging the cross-wound bobbin tube (1) opposite an image detection mechanism, detecting a digital image of one end face (27) of the cross-wound bobbin tube (1), subjecting the digital image to an edge detection in order to determine object edges (6, 7, 8, 9) of the cross-wound bobbin tube (1), determining a recognition parameter which is dependent on a width ($b_1$, $b_2$) of a circular ring (10, 11) formed by the object edges (6, 7, 8, 9), wherein the recognition parameter is selected as the quotient of an internal diameter ($d_1$, $d_2$) and an external diameter (D) of the bobbin tube (1), comparing the recognition parameter thusly determined with a reference value which is dependent on the tube parameters, and drawing a conclusion about the orientation of the cross-wound bobbin tube (1) depending on the result of the comparison.

14. A method for determining the orientation of a bobbin tube (1) of the type for cross-winding of a textile yarn thereon, wherein the bobbin tube has one end face (27) at a yarn withdrawal end of the tube configured as a tube tip (2) with a beaded edge (4) and has another end face (27) at the opposite end of the tube configured as a tube foot (3) without a beaded edge (4), the method characterized by the steps of arranging the cross-wound bobbin tube (1) opposite an image detection mechanism, detecting a digital image of one end face (27) of the cross-wound bobbin tube (1), subjecting the digital image to an edge detection in order to determine object edges (6, 7, 8, 9) of the cross-wound bobbin tube (1), determining a recognition parameter which is dependent on a width ($b_1$, $b_2$) of a circular ring (10, 11) formed by the object edges (6, 7, 8, 9), wherein the recognition parameter is selected as the quotient of an internal diameter ($d_1$, $d_2$) of the bobbin tube (1) and the width ($b_1$, $b_2$) of the circular ring (10, 11), comparing the recognition parameter thusly determined with a reference value which is dependent on the tube parameters, and drawing a conclusion about the orientation of the cross-wound bobbin tube (1) depending on the result of the comparison.

* * * * *